US009644367B2

(12) United States Patent
Kawano et al.

(10) Patent No.: US 9,644,367 B2
(45) Date of Patent: May 9, 2017

(54) JOINING STRUCTURE

(71) Applicants: SCRIMTEC JAPAN INC. CO., LTD., Chikushino-shi, Fukuoka (JP); Home Co., Ltd., Oita-shi, Oita (JP)

(72) Inventors: Yasuyuki Kawano, Chikushino (JP); Yasuo Goto, Oita (JP)

(73) Assignees: SCRIMTEC JAPAN INC. CO., LTD., Chikushino-shi (JP); Home Co., Ltd., Oita-shi (JP)

( * ) Notice: Subject to any disclaimer, the term of this patent is extended or adjusted under 35 U.S.C. 154(b) by 0 days.

(21) Appl. No.: 14/551,536

(22) Filed: Nov. 24, 2014

(65) Prior Publication Data

US 2016/0145854 A1 May 26, 2016

(51) Int. Cl.
*E04B 1/48* (2006.01)
*E04B 1/04* (2006.01)

(52) U.S. Cl.
CPC ..... *E04B 1/48* (2013.01); *E04B 1/043* (2013.01)

(58) Field of Classification Search
CPC . E04B 1/48; E04B 1/483; E04B 1/486; E04B 1/383; E04B 1/58; F16B 5/0275; F16B 12/04
USPC ..... 52/285.2, 585.1; 411/82, 82.3, 389
See application file for complete search history.

(56) References Cited

U.S. PATENT DOCUMENTS 605,468 A * 6/1898 Bennett ..... E04B 2/10 156/91
909,720 A * 1/1909 Webb ..... E04B 1/49 4/237
3,405,592 A * 10/1968 Blodee ..... F16B 12/24 403/267
3,999,339 A * 12/1976 Sappenfield ..... F16B 13/065 411/43
4,110,053 A * 8/1978 Buchholz ..... F16B 12/04 403/292
5,823,701 A * 10/1998 Goto ..... E04B 1/2604 403/10
6,036,397 A * 3/2000 Goto ..... F16B 11/006 403/265
6,120,207 A * 9/2000 Goto ..... F16B 11/006 403/230

(Continued)

FOREIGN PATENT DOCUMENTS

JP H05-331919 A 12/1993
JP 06306959 A * 11/1994

(Continued)

OTHER PUBLICATIONS 12 page machine translation of JP, 2014-020103, A from https://www.j-platpat.inpit.go.jp/web/all/top/BTmTopEnglishPage.*

*Primary Examiner* — Robert Canfield
(74) *Attorney, Agent, or Firm* — Mots Law, PLLC

(57) ABSTRACT

To provide a joining structure that joins at least two or more building members together, in which jig insertion holes into which a joining jig is inserted are provided in the building members, respectively, the joining jig is inserted into the jig insertion holes and an adhesive that fixes the joining jig and the building members together is filled in the jig insertion holes, the joining jig to be inserted into the jig insertion holes includes a cylindrical main body, an intermediate shaft portion, and threaded end portions, and the threaded end portions are provided by rolled threads.

11 Claims, 11 Drawing Sheets

(56) References Cited

U.S. PATENT DOCUMENTS 6,135,687 A * 10/2000 Leek ..... G01L 5/243 411/10
6,200,061 B1 * 3/2001 Goto ..... E04B 1/2604 403/268
6,299,397 B1 * 10/2001 Mengel ..... F16B 5/0092 411/24
8,337,112 B2 * 12/2012 Kauppila ..... E04B 1/486 29/525.02
8,740,532 B2 * 6/2014 Wiebe ..... F02F 1/24 411/389
8,919,058 B2 * 12/2014 Liberman ..... E04B 1/34823 52/122.1
2005/0204643 A1 * 9/2005 Suehiro ..... F16B 5/02 52/27
2006/0104742 A1 * 5/2006 Fleming ..... F16B 5/0275 411/389
2007/0125036 A1 * 6/2007 Schloemer ..... E04B 1/762 52/698
2009/0094916 A1 * 4/2009 Crumley ..... E04H 9/14 52/293.3
2011/0107699 A1 * 5/2011 Kawai ..... E04B 1/24 52/393
2014/0169912 A1 * 6/2014 Sutterluetti ..... E05D 5/02 411/389

FOREIGN PATENT DOCUMENTS

JP 10205047 A * 8/1998
JP H11-172781 A 6/1999
JP 3364196 B2 12/2001
JP 2008-280786 A 11/2008
JP 2013-014940 A 1/2013
JP 2014-20103 * 2/2014
JP 2014-227800 * 12/2014
WO WO 9518275 A1 * 7/1995 ..... F16B 13/141

* cited by examiner

JOINING STRUCTURE

CROSS REFERENCE TO RELATED APPLICATION

The present disclosure relates to subject matters contained in Japanese Patent Application No. 2013-110837, filed on May 27, 2013, the disclosure of which is expressly incorporated herein by reference in its entirety.

BACKGROUND OF THE INVENTION

1. Field of the Invention

The present invention relates to a joining structure using a joining jig for joining woody building members together or a woody building member to concrete, a stone material, a woody building member, an iron frame member, or the like.

2. Description of the Related Art

In recent years, medium and large-sized wooden buildings are constructed with the spread of a CLT (Cross Laminated Timber) and the like. Since the medium and large-sized wooden buildings require a high performance at joints, thus development of a joining metal having a high initial stiffness, a sufficient toughness, a stable fracture strength and high fireproof performance is demanded.

As described in the Patent Documents 1, 2 and 3 listed below, a system using both of a fully-threaded bolt or a deformed reinforcing bar and an adhesive and a lug screw system, which have a high joining performance in woody building members, are known as conventional general joining structures. The Patent Documents 4 and 5 listed below can be also related to conventional techniques.

PRIOR ART DOCUMENTS

[Patent Document 1] Japanese Patent Applications Laid-open No. Hei-05-331919

[Patent Document 2] Japanese Patent Applications Laid-open No. 2013-14940

[Patent Document 3] Japanese Patent Applications Laid-open No. 2008-280786

[Patent Document 4] Japanese Patent No. 3364196

[Patent Document 5] Japanese Patent Applications Laid-open No. Hei-11-172781

However, while the joining structure described in the Patent Document 1 is a structure in which both of a hollow fully-threaded bolt and an adhesive are used to join woody building members together, joints in the joining structure described therein cause brittle fracture and the fracture strength is affected by materials of the woody building members, which adversely varies the fracture strength.

A connecting structure described in the Patent Document 2 is a joining system constituted by a lug screw bolt and a metal that generates a friction resistance. However, while the joining system ensures a certain stiffness (rigidity) and a certain toughness, there is a problem that the joining strength and the initial stiffness are inferior to those in the joining structure described in the Patent Document 1. Furthermore, because the metal that generates a friction resistance is exposed at the joints in the joining structure described in the Patent Document 2, the appearance is deteriorated and the fireproof performance is low.

Furthermore, a connecting structure described in the Patent Document 3 is a joining system in which a rod having a deformed portion obtained by cutting a part of a deformed reinforcing bar or the like and reducing the sectional area to provide a deformation performance to a steel material and an adhesive are both used, and is a joining system having a high joining strength, a high stiffness, and a high toughness. However, in this joining system, the deformed portion is formed merely to provide the toughness and thus the cross-sectional area is set according to a yield resistance of the steel material. Furthermore, in the joining structure described in the Patent Document 3, the steel material needs to be cut to form the deformed portion, which adversely increases the cost.

SUMMARY OF THE INVENTION

An object of the present invention is to provide a joining structure capable of providing a high initial stiffness (rigidity), a sufficient toughness, and a stable fracture strength at a joint that joins woody building members together and suppressing the cost.

A first aspect of the present invention provides a joining structure that joins at least two or more building members together, wherein jig insertion holes into which a joining jig is inserted are provided in the building members, respectively, the joining jig is inserted into the jig insertion holes and an adhesive that fixes the joining jig and the building members together is filled in the jig insertion holes, the joining jig to be inserted into the jig insertion holes is formed cylindrically, has a pair of threaded end portions formed at both ends thereof, respectively, and has a non-threaded intermediate shaft portion formed between the pair of threaded end portions, the threaded end portions are formed by rolling, one of the pair of threaded end portions is placed in a jig insertion hole of one of the building members, and the other one of the pair of threaded end portions is placed in a jig insertion hole of the other one of the building members.

A second aspect of the present invention provides a joining structure that joins at least two or more building members together, wherein jig insertion holes into which a joining jig is inserted are provided in the building members, respectively, the joining jig is inserted into the jig insertion holes and an adhesive that fixes the joining jig and the building members together is filled in the jig insertion holes, the joining jig to be inserted into the jig insertion holes is formed cylindrically, has a pair of threaded end portions formed at both ends thereof, respectively, and has a non-threaded intermediate shaft portion formed between the pair of threaded end portions, the threaded end portions are formed by rolling, one of the pair of threaded end portions is placed in a jig insertion hole of one of the building members, and the other one of the pair of threaded end portions is inserted into an opening of a baseplate and is fixed to the baseplate with a nut.

A third aspect of the present invention is the joining structure according to the first or second aspect, wherein a slit portion is provided in the intermediate shaft portion of the joining jig, an outside diameter of the slit portion is formed smaller than a root diameter of threads of the threaded end portions, and the slit portion is provided near one of the pair of threaded end portions and is placed in a jig insertion hole of one of the building members.

BRIEF DESCRIPTION OF THE DRAWINGS

The above and further objects and novel features of the present invention will more fully appear from the following detailed description when the same is read in conjunction with the accompanying drawings, in which.

DETAILED DESCRIPTION OF THE EMBODIMENTS

Figure 1:
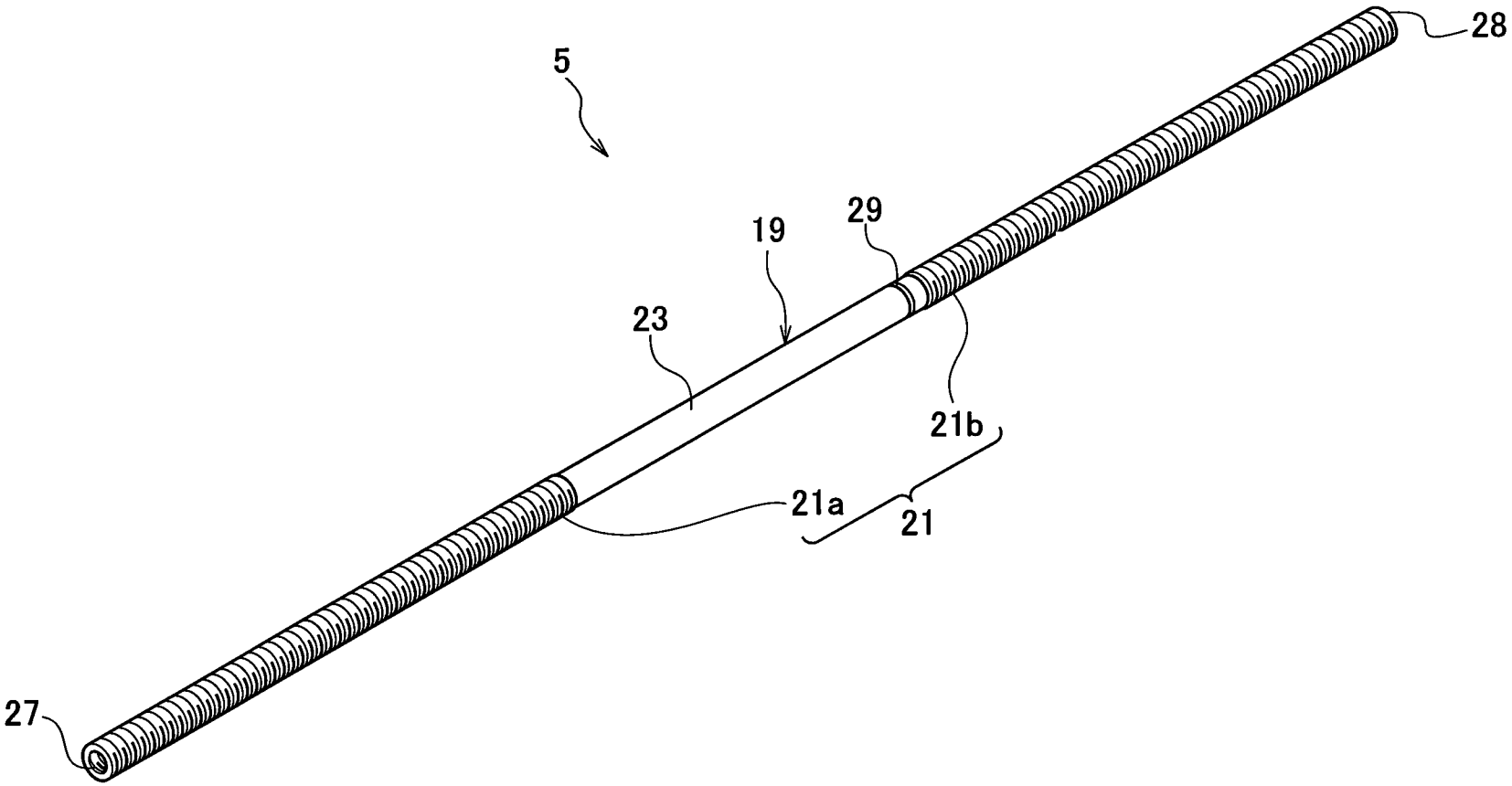
FIG. 1 is a perspective view of a joining jig used for a joining structure according to the present invention.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

Description will be hereinbelow provided for an embodiment of the present invention by referring to the drawings. It should be noted that the same or similar parts and components throughout the drawings will be denoted by the same or similar reference signs, and that descriptions for such parts and components will be omitted or simplified. In addition, it should be noted that the drawings are schematic and therefore different from the actual ones.

Embodiments and modifications of the present invention are explained below with reference to the drawings.

[First Embodiment]

A joining structure 1 according to a first embodiment of the present invention is explained with reference to FIGS. 1 to 3.

As shown in FIGS. 1, 2A, 2B, and 2C, a joining jig 5 made of a steel material used for the joining structure 1 is created, for example, by forming a pair of threaded end portions (external thread end portions) 21 (21*a* and 21*b*) by rolling (rolled thread) at longitudinal both ends of an elongate cylindrical material 19 made of an iron alloy such as steel. There is a non-threaded cylindrical intermediate shaft portion 23 between the pair of threaded end portions 21. That is, one threaded end portion 21*a*, the intermediate shaft portion 23, and the other threaded end portion 21*b* are arranged in this order in the longitudinal direction of the joining jig 5 and are coupled together.

The outside diameter of the intermediate shaft portion 23 is equal to the outside diameter of the material 19 and the inside diameter of the intermediate shaft portion 23 is equal to the inside diameter of the material 19. The threaded end portions 21 are also hollow and the inside diameter of the threaded end portions 21 is also equal to the inside diameter of the material 19.

Because the threaded end portions 21 are formed by rolling (rolled thread), the outside diameter of the intermediate shaft portion 23 is larger than the root diameter (core diameter, minor diameter) of the threaded end portions 21, smaller than the external diameter (major diameter) of the threaded end portions 21, and substantially equal to the pitch diameter (effective diameter) of the threaded end portions 21.

A hollow portion (a hollow portion in a shape same as that of the cylindrical material 19) 25 on the inner circumferential side of the joining jig 5 is configured to be filled with an adhesive 10, which is explained in detail later.

Figure 2C:
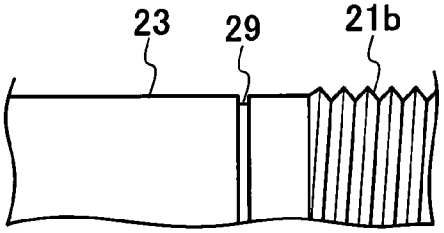
FIG. 2C is a partially enlarged view of the joining jig used for the joining structure according to the present invention.
Figure 2A:
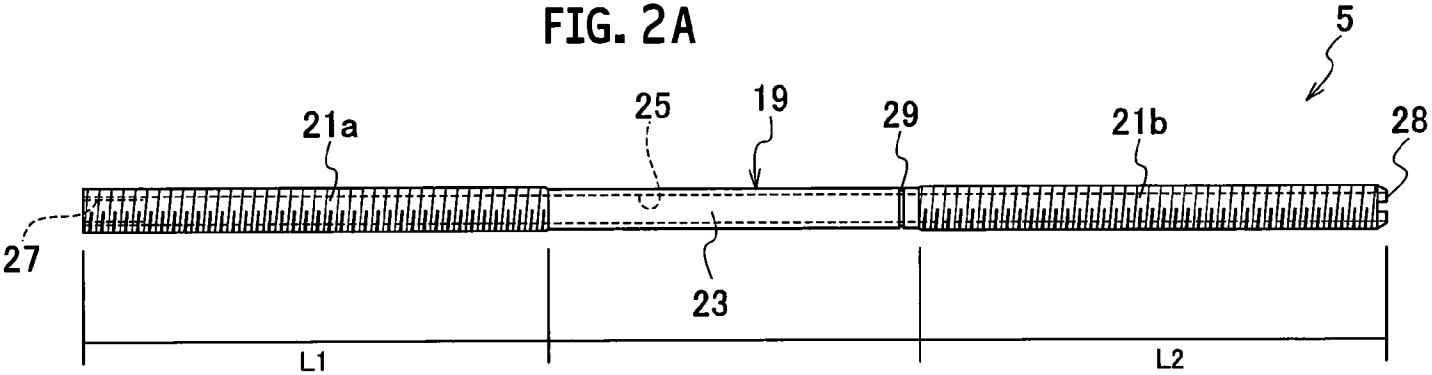
FIG. 2A is a side view of the joining jig used for the joining structure according to the present invention.
Figure 2B:
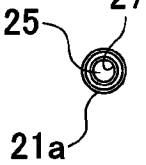
FIG. 2B is a side view showing an end portion of the joining jig used for the joining structure according to the present invention.

As shown in FIGS. 2A and 2B, an adapter attachment portion 27 to which an adapter for filling the adhesive 10, which is explained later, is attached is formed at the first threaded end portion 21*a* being one of the threaded end portions 21. The adapter attachment portion 27 is formed of, for example, internal threads. The internal threads are provided on the inner circumference of the hollow portion 25 at one of longitudinal ends of the joining jig 5. The adapter attachment portion 27 thus naturally communicates with the hollow portion 25. While the adapter attachment portion 27 is formed at the first threaded end portion 21*a* in the above explanations, the adapter attachment portion 27 can be formed at the second threaded end portion 21*b*.

While a length L1 of the first threaded end portion 21*a* and a length L2 of the second threaded end portion 21*b* are set equal in the first embodiment, the lengths of the threaded end portions on the both ends are not necessarily the same.

The intermediate shaft portion 23 arranged to be sandwiched between the first threaded end portion 21*a* and the second threaded end portion 21*b* is made of the steel material as described above and thus extensionally deforms (elastically deforms or plastically deforms) in a direction in which the first threaded end portion 21*a* and the second threaded end portion 21*b* are separated from each other. At a part of the intermediate shaft portion 23 near the second threaded end portion 21*b*, a slit portion (an annular recess; a small diameter portion) 29 is formed to be recessed as shown in FIG. 2C.

The outside diameter of the slit portion 29 formed on the joining jig 5 is set smaller than the root diameter of the threaded end portions 21. For example, when the outside diameter of the intermediate shaft portion 23 is 21.7 millimeters, the root diameter of the threaded end portions 21 is 20.7 millimeters and the outside diameter of the slit portion 29 is 20.6 millimeters.

By setting the outside diameter of the slit portion 29 smaller than those of other parts of the joining jig 5 in this way, the fracture strength of the slit portion 29 can be adjusted to enable breaking to occur at the slit portion 29. That is, by appropriately changing the outside diameter of the slit portion 29, the fracture strength of the joining jig 5 can be adjusted.

Figure 3:
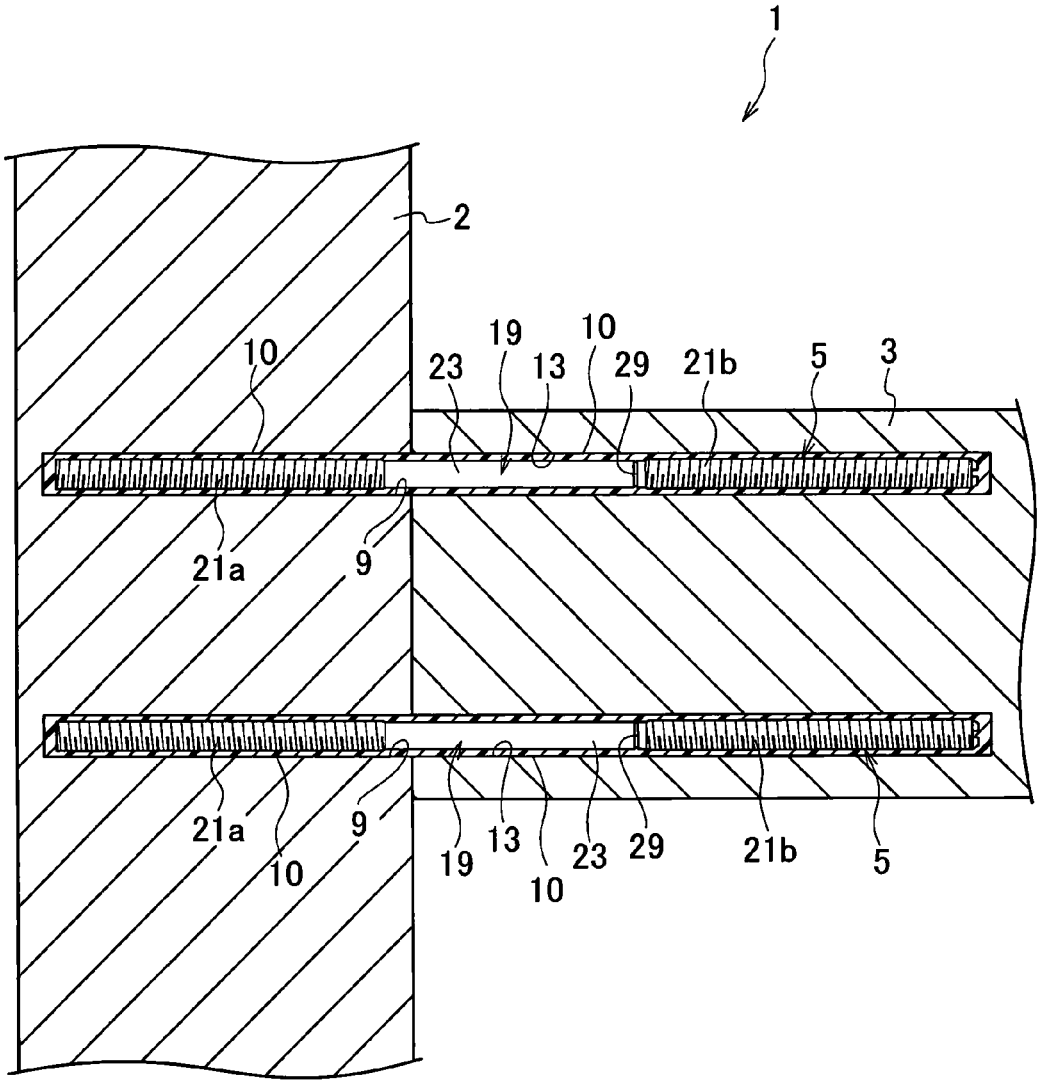
FIG. 3 is a partial sectional view showing the joining structure according to the present invention.

As shown in FIG. 3, a building member according to the first embodiment includes two building members 2 and 3.

On one planar surface side of the first building member 2, first jig insertion holes 9 into each of which the first threaded end portion 21*a* of the joining jig 5 is inserted and the adhesive 10 is filled are formed. The first jig insertion holes 9 are set larger than the diameter of the first threaded end portion 21*a* of the joining jig 5 described above.

Also on one planar surface side of the second building member 3, second jig insertion holes 13 into each of which the second threaded end portion 21*b* of the joining jig 5 is inserted and the adhesive 10 is filled are formed. The second jig insertion holes 13 are also set larger than the diameter of the second threaded end portion 21*b*.

The adhesive 10 filled in the first and second jig insertion holes 9 and 13 is injected to be filled in gaps between the first and second jig insertion holes 9 and 13 and the joining jig 5 inserted thereinto.

As the adhesive 10, an adhesive that is a liquid when injected into the first and second jig insertion holes 9 and 13 and that hardens in the first and second jig insertion holes 9 and 13 from the liquid into a solid state is preferable and an epoxy resin is used, for example.

In the first embodiment, before joining the first building member 2 and the second building member 3, the adhesive 10 is previously filled in the first jig insertion holes 9 and the second jig insertion holes 13. The joining jigs 5 are inserted into the first jig insertion holes 9 and the second jig insertion holes 13 after the adhesive 10 is filled therein, thereby joining the first building member 2 and the second building member 3 together.

The first jig insertion hole 9 and the second jig insertion hole 13 have the same diameter and communicate with each other. In the longitudinal direction (the lateral direction in FIG. 3) of the joining jig 5, the intermediate shaft portion 23 is positioned at a joint surface (the right end surface of the first building member 2 in FIG. 3 and the left end surface of the second building member 3 in FIG. 3) between the first building member 2 and the second building member 3, for example. While a left-hand part (a part on the side of the threaded end portion 21*a*) of the intermediate shaft portion 23 is positioned at the joint surface between the first building member 2 and the second building member 3 in the longitudinal direction of the joining jig 5 in FIG. 3, an arbitrary part of the intermediate shaft portion 23 can be positioned at the joint surface between the first building member 2 and the second building member 3 in the longitudinal direction of the joining jig 5.

The slit portion 29 is located away from the joint surface between the first building member 2 and the second building member 3 in the longitudinal direction of the joining jig 5. Accordingly, even when the joining jig 5 is broken at the slit portion 29, an immediate fall of the second building member 3 from the first building member 2 is prevented, for example.

Because the adhesive 10 is filled between threads of the threaded end portions 21 of the joining jig 5, the bond strength between the threaded end portions 21 and the adhesive 10 can be ensured. In contrast thereto, because no threads are formed on the intermediate shaft portion 23, the bond strength of the adhesive 10 is lower than that at the threaded end portions 21. Accordingly, when an excessive force (an external force) is applied in a direction in which the first building member 2 and the second building member 3 are separated from each other, the intermediate shaft portion 23 extensionally deforms due to yielding of the steel material and the joining jig 5 can be caused to be broken at the slit portion 29 formed on the intermediate shaft portion 23. That is, because the bond strength between the threaded end portions 21 and the adhesive 10 can be set higher than the yielding or the fracture strength of the steel material of the intermediate shaft portion 23, breaking can be caused to occur at the intermediate shaft portion 23 without occurring of breaking or the like at the threaded end portions 21.

To explain more specifically, because the threaded end portions 21 are formed by rolling (rolled thread) in the joining structure 1, the outside diameter of the intermediate shaft portion 23 is smaller than the external diameter (major diameter) of the threaded end portions 21, larger than the root diameter (core diameter, minor diameter) of the threaded end portions 21, and substantially equal to the pitch diameter (effective diameter) of the threaded end portions 21 as described above.

Furthermore, because the joining jig 5 is formed cylindrically, the stiffness of the joining jig 5 with respect to the tension (the tension acting in the longitudinal direction) can be adjusted. That is, the stiffness of the joining jig 5 with respect to the tension is increased by reducing the inside diameter of the joining jig 5, and the stiffness of the joining jig 5 with respect to the tension is reduced by increasing the inside diameter of the joining jig 5. Therefore, by setting the inside diameter of the joining jig 5 to an appropriate size, the stiffness (rigidity) or the strength of the joining jig 5 with respect to the tension can be appropriately set.

Further, one threaded end portion 21*a* of the joining jig 5 is placed in the jig insertion hole 9 of one building member 2, which is filled with the adhesive 10, and the other threaded end portion 21*b* of the joining jig 5 is placed in the jig insertion hole 13 of the other building member 3, which is filled with the adhesive 10.

Accordingly, the intermediate shaft portion (the cylindrical intermediate shaft portion) 23 having no threads formed thereon (non-threaded) of the joining jig 5 locates (extends), for example, at a position where one building member 2 and the other building member 3 are in contact with each other. Therefore, when an external force (a force separating the building members 2 and 3 from each other) is applied to the respective building members 2 and 3, the intermediate shaft portion 23 of the joining jig 5 receives the force and thus a tensile stress occurs on the intermediate shaft portion 23 of the joining jig 5.

By setting the inside diameter of the tubular joining jig 5 to an appropriate size, the stiffness (the tensile strength) of the intermediate shaft portion 23 in the joining jig 5 can be set smaller than the stiffness (the tensile strength) at joint places between the helically threaded end portions 21 and the adhesive 10, the stiffness (the tensile strength) at joint places between the adhesive 10 and the jig insertion holes 9 and 13, and the stiffness (the tensile strength) of the building members 2 and 3 when the external force mentioned above is applied to the building members 2 and 3.

By setting the stiffness (the tensile strength) of the intermediate shaft portion 23 smaller as described above, the intermediate shaft portion 23 is caused to easily deform when the external force mentioned above is applied thereto, the toughness to the external force can be easily set to a fixed value, variations in the strength among a plurality of joining structures are reduced (variations in the toughness due to individual differences of the joining structure 1 are reduced), the toughness is provided, and the quality of the joining structure 1 is stabilized.

If a joining jig is formed solid and no intermediate shaft portion is provided in the joining jig (see Japanese Patent Application Laid-open No. H05-331919), the stiffness of the solid joining jig having no intermediate shaft portion is higher than the stiffness at joint places between threaded portions and an adhesive, the stiffness at joint places between the adhesive and jig insertion holes, and the stiffness of building members. Accordingly, when the external force mentioned above is applied thereto, the joint places between the threaded portions and the adhesive, the joint places between the adhesive and the jig insertion holes, or the building members, which have smaller stiffness, are broken earlier than (prior to) the joining jig.

The external force required for breaking has large variations due to factors such as individual differences of the building members or situations in which the adhesive is hardened. In contrast thereto, if the stiffness of the intermediate shaft portion 23 made of, for example, steel is set low in the joining jig 5 as described above, the variations in the stiffness (the tensile strength) can be reduced and thus the quality of the joining structure 1 can be stabilized.

Furthermore, when the external force is applied, the outside diameter of the intermediate shaft portion 23 tends to diminish according to the Poisson' ratio. Accordingly, even when the adhesive 10 is filled around the intermediate shaft portion 23, the joint strength between the intermediate shaft portion 23 and the adhesive 10 is reduced and thus the variations in the toughness can be reduced by eliminating an influence of the adhesion force as much as possible.

Further, when the joining jig 5 is broken at the slit portion 29, slipping-down of a building member along with breaking of the joining jig 5 can be prevented because the intermediate shaft portion 23 is inserted into the first jig insertion hole 9 and the second jig insertion hole 13 formed in the first building member 2 and the second building member 3 as described above.

In addition, because the joining jig 5 can be provided by forming the threaded end portions 21 with rolled threads and recessing the slit portion 29, unnecessary cutting processing is not performed and thus the manufacturing cost can be reduced.

Next, modifications of the joining structure 1 are explained below with reference to FIGS. 4 to 7. Explanations of configurations identical to those in the first embodiment described above will be omitted.

[First Modification]

Figure 4:
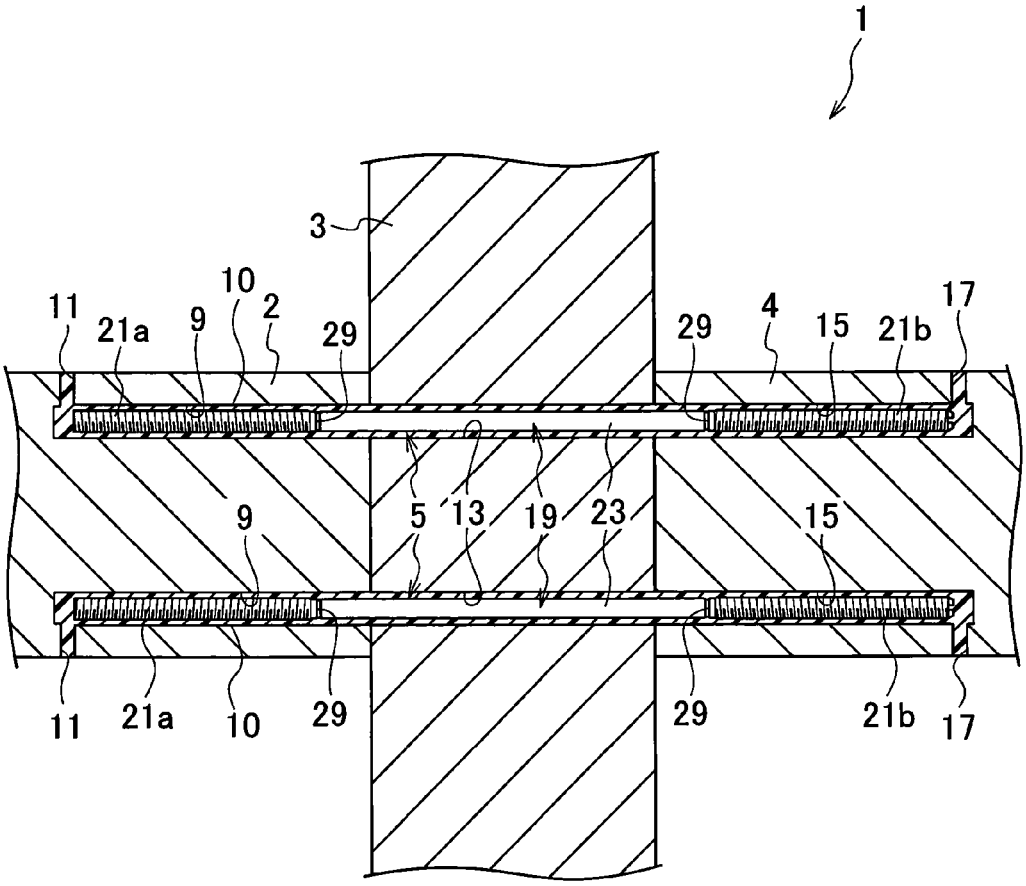
FIG. 4 is a partial sectional view of a joining structure according to a first modification.

In a first modification of the first embodiment shown in FIG. 4, a building member includes three building members 2, 3, and 4.

In this joining structure 1, adhesive injection holes 11 are formed to open to the first jig insertion holes 9, respectively, into each of which the first threaded end portion 21*a* of the joining jig 5 is inserted on one surface side of the first building member 2. The adhesive 10 is injected to the adhesive injection holes 11 from the other surface side of the first building member 2.

Second jig insertion holes 13 are provided in the second building member 3 to pass through the second building member 3.

Third jig insertion holes 15 into each of which the second threaded end portion 21*b* of the joining jig 5 is inserted are formed on one surface side of the third building member 4. On the bottom side of each of the third jig insertion holes 15, an adhesive discharge hole 17 from which the adhesive 10 injected from the adhesive injection hole 11 is discharged is formed.

That is, the first jig insertion hole 9 and the third jig insertion hole 15 communicate with each other via the second jig insertion hole 13. The adhesive 10 injected from the adhesive injection holes 11 of the first building member 2 is filled in the first jig insertion holes 9, the second jig insertion holes 13, and the third jig insertion holes 15 and then is discharged from the adhesive discharge holes 17 formed in the third building member 4. Filling of the adhesive 10 is completed by visual confirmation of the adhesive 10 discharged from the adhesive discharge holes 17.

According to the first modification, effects identical to those in the first embodiment described above can be obtained.

By closing the adhesive injection holes 11 and the adhesive discharge holes 17 with wooden plugs or the like after completion of filling of the adhesive 10, joining of the first, second, and third building members 2, 3, and 4 can be achieved without deteriorating the aesthetic appearance.

[Second Modification]

A Second Modification of the First Embodiment is Explained Next with reference to FIG. 5.

Figure 5:
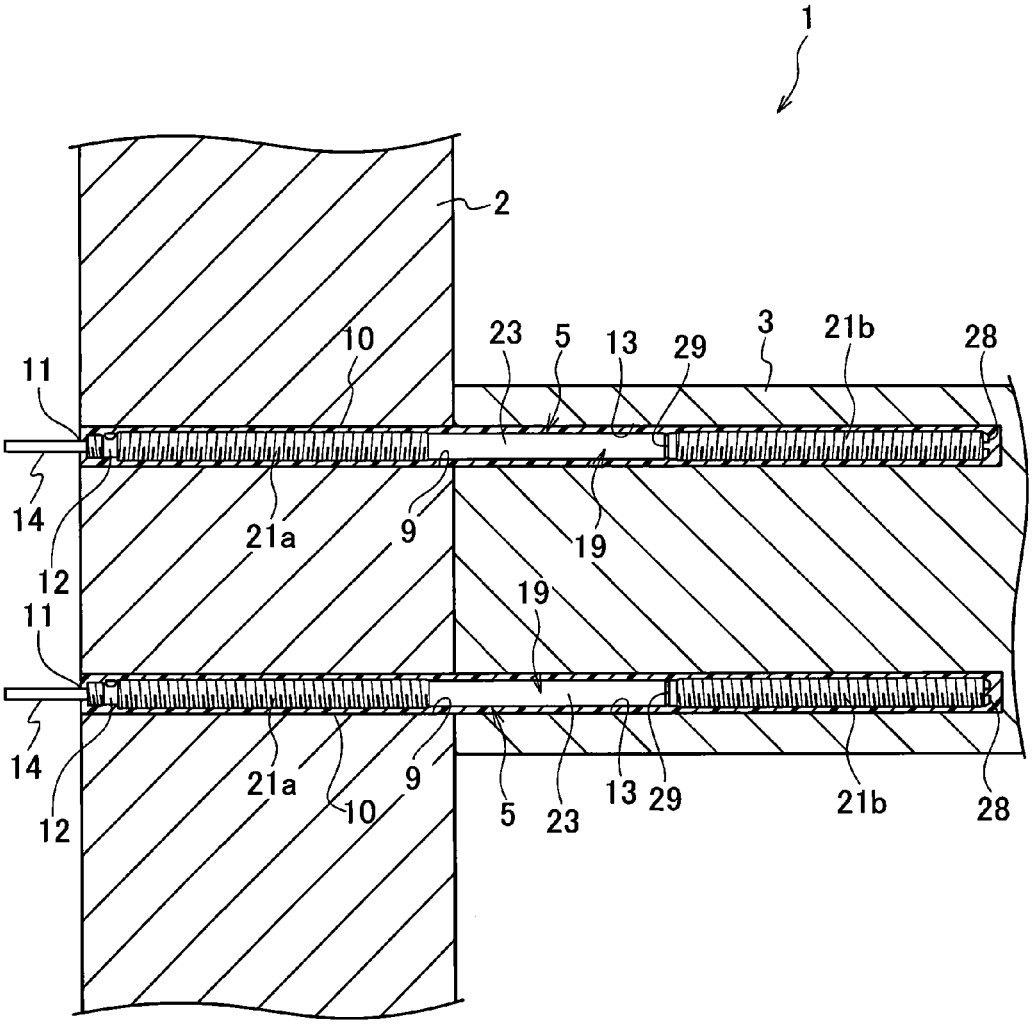
FIG. 5 is a partial sectional view of a joining structure according to a second modification.

In the second modification shown in FIG. 5, a building member includes the two building members 2 and 3 as in the first embodiment.

In this joining structure 1, the first jig insertion holes 9 are provided to pass through the first building member 2 and the first jig insertion holes 9 and the adhesive injection holes 11 are formed contiguously.

Adapters 12 used for injecting the adhesive 10 are screwed and attached to the adapter attachment portions 27 (see FIGS. 2A and 2B) each formed on the inner circumferential side of the first threaded end portion 21*a* of the joining jig 5, and the adhesive 10 is injected to the inner circumferential side of the joining jig 5 from a tube 14 coupled to each of the adapters 12.

That is, the first jig insertion holes 9 formed in the first building member 2 and the second jig insertion holes 13 formed in the second building member 3 are arranged to communicate with each other, and then the joining jigs 5 are inserted into the first and second jig insertion holes 9 and 13. At that time, the adapters 12 are already attached to the adapter attachment portions 27 formed in the first threaded end portions 21*a* of the joining jigs 5, respectively.

Each of the adapters 12 is attached to the adapter attachment portion 27 formed on the inner circumferential side of the first threaded end portion 21*a* of the joining jig 5 that is inserted into the first and second jig insertion holes 9 and 13. The adhesive 10 passes from the tubes 14 coupled to the adapters 12 through the inner circumferential sides of the joining jigs 5, the adhesive 10 is discharged from open ends 28 of the second threaded end portions 21*b*, the adhesive 10 is filled in the second jig insertion holes 13, and the adhesive 10 is also filled in the first jig insertion holes 9. Filling of the adhesive 10 is completed by discharge of the adhesive 10 from the adhesive injection holes 11.

Also in the second modification, by closing the adhesive injection holes 11 with wooden plugs or the like, joining of the first and second building members 2 and 3 can be achieved without deteriorating the aesthetic appearance.

[Third Modification]

A third modification of the first embodiment is explained next with reference to FIG. 6.

Figure 6:
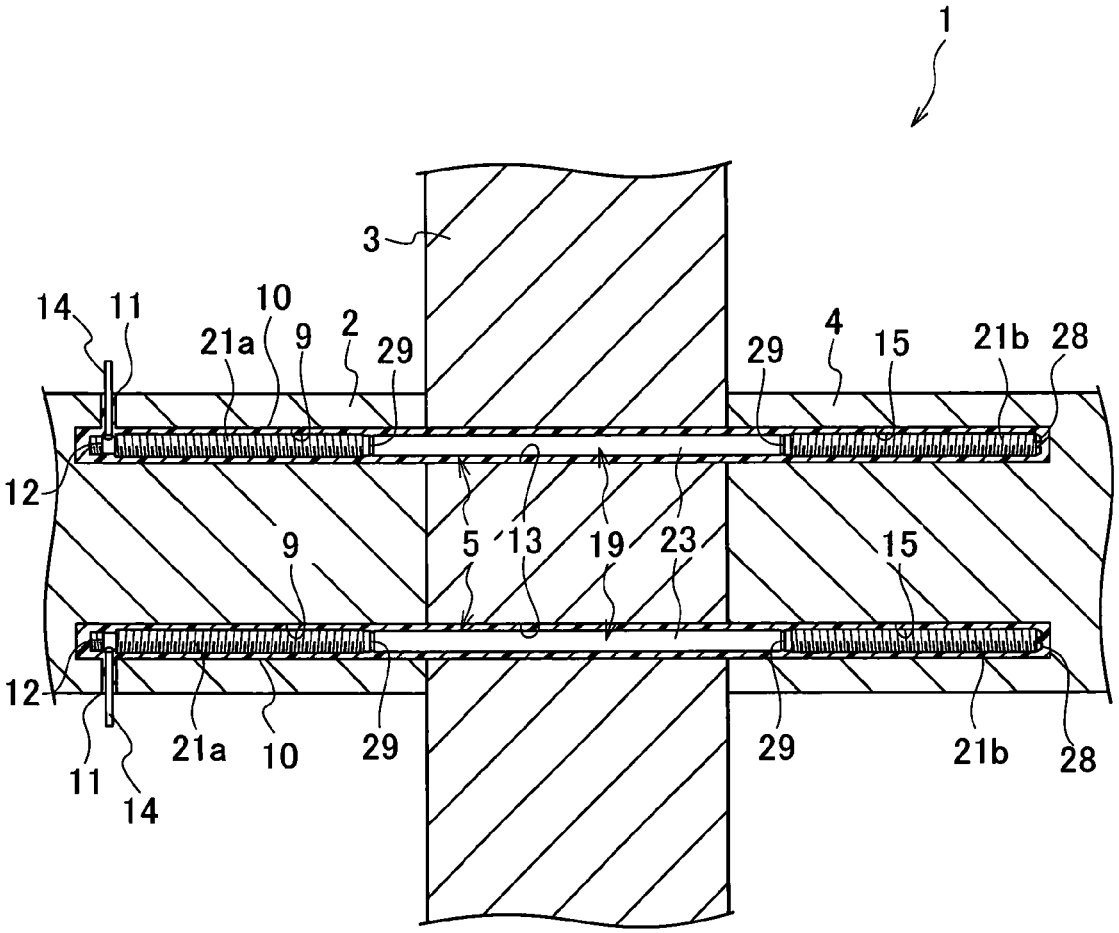
FIG. 6 is a partial sectional view of a joining structure according to a third modification.

In the third modification shown in FIG. 6, a building member includes the three building members 2, 3, and 4 as in the first modification shown in FIG. 4.

In this joining structure 1, the adhesive injection holes 11 are provided to open to end portions of the first jig insertion holes 9 formed in the first building member 2, respectively. The slit portion 29 is formed also at a part of the intermediate shaft portion 23 on the side of the first threaded end portion 21*a* of the joining jig 5 according to the third modification.

In the third modification, the first jig insertion holes 9 of the first building member 2 and the second jig insertion holes 13 of the second building member 3 are arranged to communicate with each other and the joining jigs 5 are inserted into the second jig insertion holes 13 and the first jig insertion holes 9. In this state, the second threaded end portions 21*b* of the joining jigs 5 protrude out of one surface side of the second building member 3.

At that time, the first threaded end portions 21*a* are inserted into the first jig insertion holes 9 in a state where the adapters 12 are attached thereto, respectively.

In this state, the tubes 14 are inserted from the adhesive injection holes 11 formed in the first building member 2 and are coupled to the adapters 12, respectively.

The second threaded end portions 21*b* protruding out of the one surface side of the second building member 3 are inserted into the third jig insertion holes 15 of the third building member 4, respectively.

In a state where the joining jigs 5 are inserted into the first, second, and third jig insertion holes 9, 13, and 15, the adhesive 10 is injected to the inner circumferences of the joining jigs 5 via the tubes 14.

The adhesive 10 injected to the inner circumferences of the joining jigs 5 is discharged from the open ends 28 of the second threaded end portions 21*b*, is filled in the third jig insertion holes 15 and the second jig insertion holes 13, and then the adhesive 10 is injected into the first jig insertion holes 9. Filling of the adhesive 10 is completed by discharge of the adhesive 10 from the adhesive injection holes 11.

Also in the third modification, by closing the adhesive injection holes 11 with wooden plugs or the like, joining of the first, second, and third building members 2, 3, and 4 can be achieved without deteriorating the aesthetic appearance.

[Fourth Modification]

A fourth modification of the first embodiment is explained next with reference to FIG. 7.

The fourth modification provides joining between the first building member 2 made of wood and a foundation material 6 made of reinforced concrete or the like together.

Figure 7:
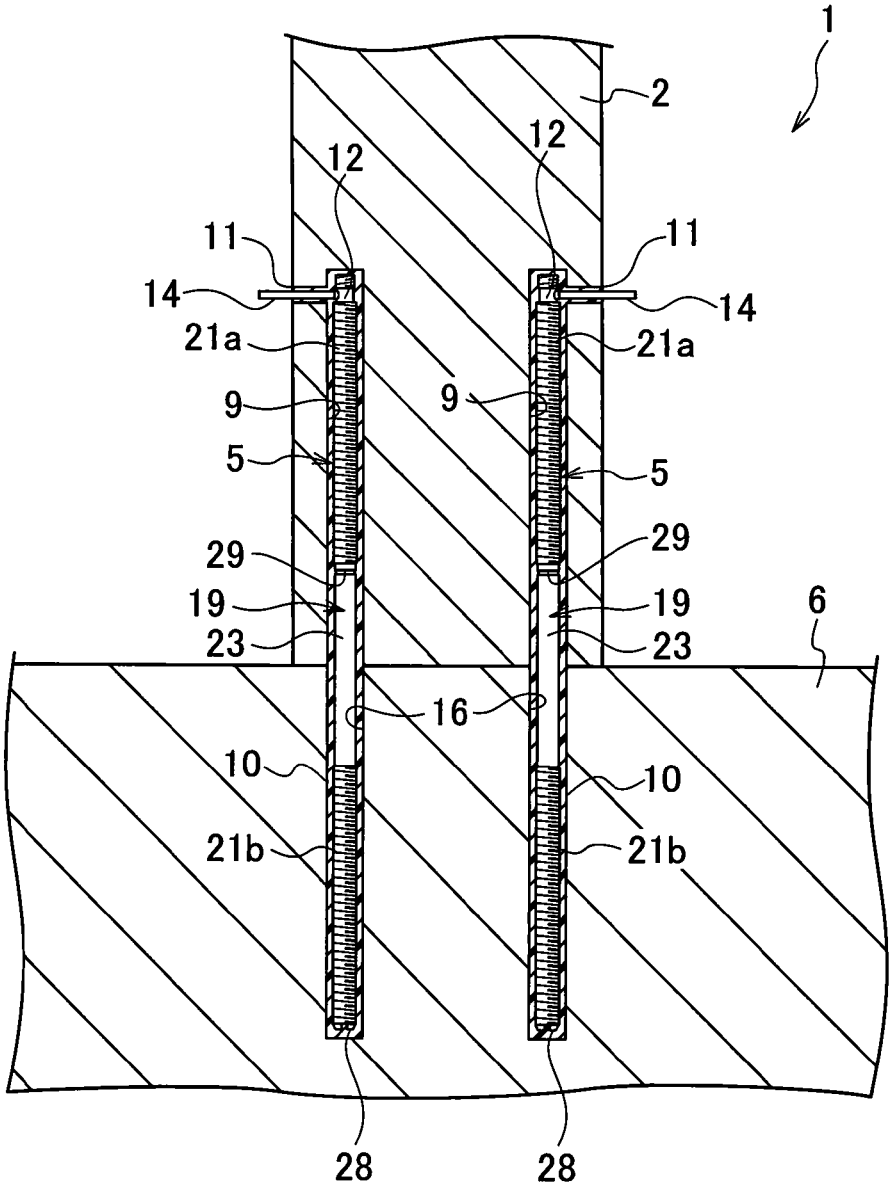
FIG. 7 is a partial sectional view of a joining structure according to a fourth modification.

As shown in FIG. 7, fourth jig insertion holes 16 into each of which the joining jig 5 is inserted are formed in the foundation material 6.

Also in the fourth modification, the adhesive injection holes 11 are provided in the first building member 2.

In the fourth modification, the adapters 12 are attached to the adapter attachment portions 27 (see FIGS. 2A and 2B) of the first threaded end portions 21*a*, the joining jigs 5 are inserted into the first jig insertion holes 9 of the first building member 2, and the tubes 14 are inserted from the adhesive injection holes 11 to be coupled to the adapters 12, respectively. The second threaded end portions 21*b* of the joining jigs 5 protruding out of the first building member 2 are inserted into the fourth jig insertion holes 16 of the foundation material 6, respectively.

The adhesive 10 is injected to the inner circumferences of the joining jigs 5 from the tubes 14 that are attached to the adapters 12 of the joining jigs 5 inserted into the first and fourth jig insertion holes 9 and 16.

The adhesive 10 injected to the inner circumferences of the joining jigs 5 is discharged from the open ends 28 of the second threaded end portions 21*b*, and is filled in the fourth jig insertion holes 16 and the first jig insertion holes 9. Filling of the adhesive 10 is completed by discharge of the adhesive 10 from the adhesive injection holes 11.

Also in the fourth modification, by closing the adhesive injection holes 11 with wooden plugs or the like, joining between the first building member 2 and the foundation material 6 can be achieved without deteriorating the aesthetic appearance.

In the first to fourth modifications described above, effects identical to those in the first embodiment described above can be obtained.

[Second Embodiment]

Figure 8:
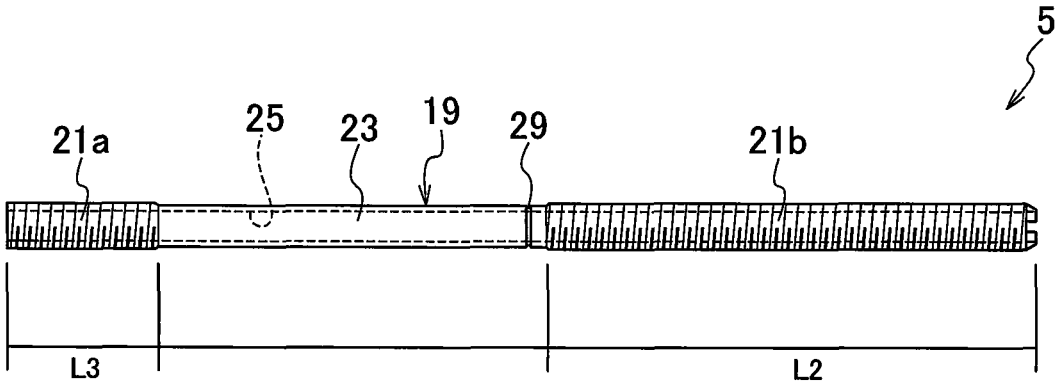
FIG. 8 is a side view of a joining jig according to a second embodiment of the present invention.

A second embodiment of the present invention is explained next with reference to FIGS. 8 and 9. Explanations of configurations identical to those in the first embodiment described above will be omitted.

In the joining structure 1 according to the second embodiment, a length L3 of the first threaded end portion 21*a* of the joining jig 5 is set smaller than the length L2 of the second threaded end portion 21*b*.

Figure 9:
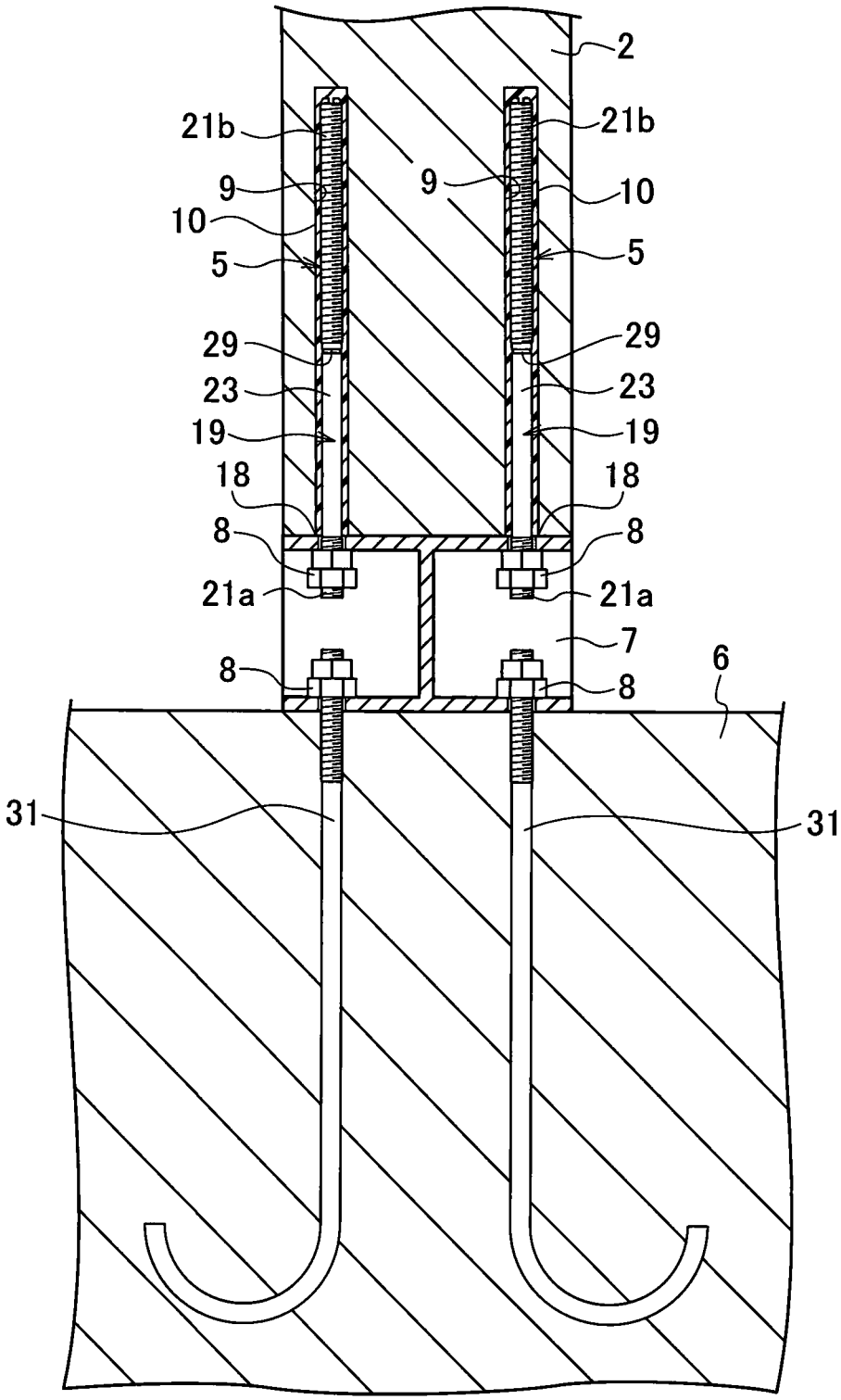
FIG. 9 is a partial sectional view of the joining jig according to the second embodiment.

This joining structure 1 is applied to a case where joining of the first building member 2 and the foundation material 6 is performed with a baseplate 7 interposed therebetween when the first building member 2 and the foundation material 6 are to be joined together as shown in FIG. 9, and the like.

As shown in FIG. 9, in the foundation material 6, buried portions 31 for fixing the baseplate 7 to the foundation material 6 are buried to protrude at one of end sides out of the foundation material 6. The baseplate 7 is fixed to parts of the buried portions 31 protruding out of the foundation material 6 with nuts 8.

The baseplate 7 is a metal formed substantially H-shaped in cross-section and has openings 18 for fixing the joining jigs 5 formed therein, respectively.

The first threaded end portion 21*a* of the joining jig 5 is inserted into each of the openings 18, and the joining jig 5 is fixed to the baseplate 7 with the nut 8.

In the second embodiment, the joining jigs 5 are first inserted into the first jig insertion holes 9 of the first building member 2, the adhesive 10 is injected to and is filled in the first jig insertion holes 9, thereby fixing the first building member 2 and the joining jigs 5 together.

The first threaded end portions 21*a* of the joining jigs 5 fixed to the first building member 2 are then inserted into the openings 18 of the baseplate 7, and the joining jigs 5 and the baseplate 7 are fixed together with the nuts 8.

According to the second embodiment, in addition to the effect of the first embodiment described above, even when a baseplate or the like is interposed between building members in joining the building members together, the lengths of the threaded end portions can be appropriately changed.

[Third Embodiment]

A third embodiment of the present invention is explained next with reference to FIGS. 10 and 11. Explanations of configurations identical to those in the first and second embodiments described above will be omitted.

The joining structure 1 according to the third embodiment includes three building members, which are coupled together with joining jigs 50 as the joining jigs described above.

Figure 10:
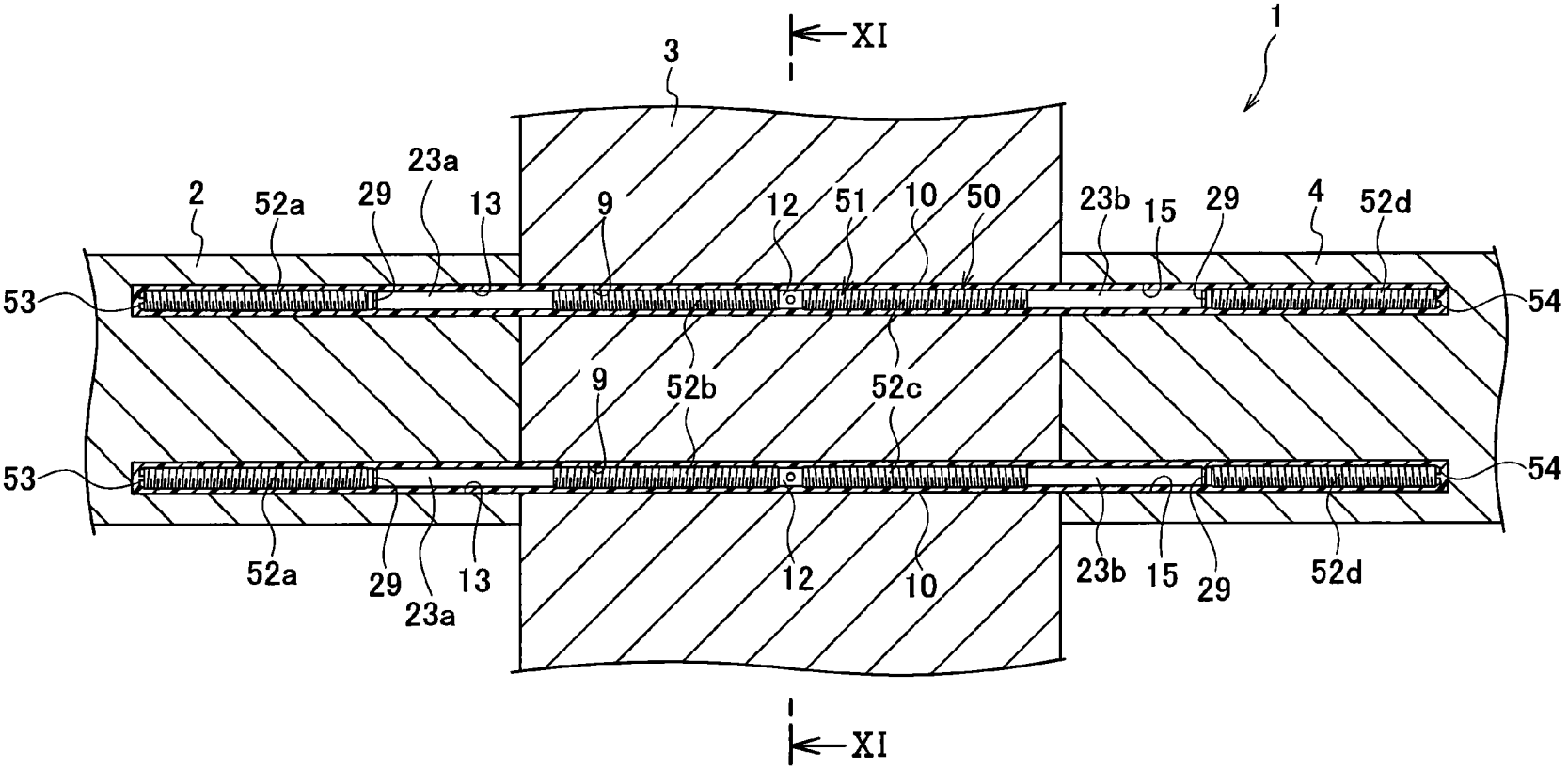
FIG. 10 is a partial sectional view of a joining jig according to a third embodiment of the present invention.

As shown in FIG. 10, each of the joining jigs 50 according to the third embodiment includes the threaded end portions 21 formed of the cylindrical material 19 by rolling, and the intermediate shaft portions 23 not subjected to processing such as rolling and retaining the form of the material 19, similarly in the first embodiment described above.

The threaded end portions 21 include a first threaded end portion 52*a* to be inserted into the first building member 2, second and third threaded end portions 52*b* and 52*c* to be inserted into the second building member 3, and a fourth threaded end portion 52*d* to be inserted into the third building member 4.

The adapter 12 is formed between the second threaded end portion 52*b* and the third threaded end portion 52*c* and the adhesive 10 is injected to the inner circumferential side of the joining jig 50 by inserting the tube 14 into the adapter 12 and injecting the adhesive 10 through the tube 14.

The intermediate shaft portions 23 include a first intermediate shaft portion 23*a* and a second intermediate shaft portion 23*b* and the slit portion 29 is formed on each of the first intermediate shaft portion 23*a* and the second intermediate shaft portion 23*b*.

Figure 11:
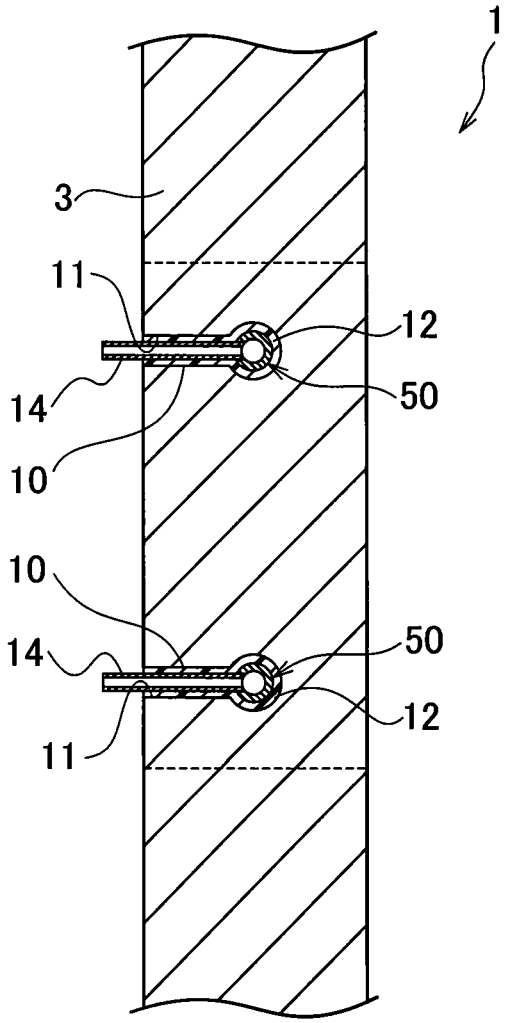
FIG. 11 is a sectional view taken along a line XI-XI of FIG. 10 according to the third embodiment.

As shown in FIG. 11, the adhesive injection holes 11 into which the adhesive 10 is injected are provided in the second building member 3 and the adhesive injection holes 11 open to positions where the adapter 12 mentioned above is located.

In the third embodiment, each of the joining jigs 50 is inserted into the first jig insertion hole 9 of the second building member 3 and is positioned in such a manner that the first threaded end portion 52*a* and the fourth threaded end portion 52*d* protrude out of the second building member 3.

The first threaded end portion 52*a* and the fourth threaded end portion 52*d* protruding out of the second building member 3 are relatively inserted into the second jig insertion hole 13 of the first building member 2 and the third jig insertion hole 15 of the third building member 4, respectively.

The tubes 14 are then coupled to the adapters 12, respectively, and the adhesive 10 is injected to the inner circumferential sides of the joining jigs 50. The adhesive 10 injected to the inner circumferential sides of the joining jigs 50 passes through the inner circumferential sides of the joining jigs 50, is discharged from open ends 53 of the first threaded end portions 52*a* and from open ends 54 of the fourth threaded end portions 52*d*, is filled in the second jig insertion holes 13 and the third jig insertion holes 15, flows into the first jig insertion holes 9, and is discharged from the adhesive injection holes 11 of the second building member 3, whereby filling of the adhesive 10 is completed.

Also in the third embodiment, by closing the adhesive injection holes 11 with wooden plugs or the like, joining of the first, second, and third building members 2, 3, and 4 can be achieved without deteriorating the aesthetic appearance.

According to the third embodiment, in addition to the effects of the first and second embodiments described above, the length of the joining jig can be appropriately changed even when thick building members are to be joined together.

It is preferable that a plurality of the jig joining holes into which the joining jig is inserted are provided in each of building members in the first embodiment, the modifications thereof, the second embodiment, and the third embodiment described above.

It is also preferable that the thickness of the main body of each of the joining jigs according to the first embodiment, the modifications thereof, the second embodiment, and the third embodiment described above is set to a thickness that causes yielding of a steel material at the joining strength or at the lower joining strength between the threaded end portions and the adhesive or a lower joining strength.

Furthermore, by using a steel material having a yield ratio equal to or lower than 80%, such as common steel or low yield point steel, the joining jigs according to the present invention can provide a stable breaking strength.

In addition, the joining structures according to the present invention are not limited to the numerical values as described above and the values can be of course appropriately changed.

Embodiments of the present invention have been described above. However, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

Moreover, the effects described in the embodiments of the present invention are only a list of optimum effects achieved by the present invention. Hence, the effects of the present invention are not limited to those described in the embodiment of the present invention.

What is claimed is:

1. A joining structure that joins at least two or more building members together, wherein jig insertion holes into which a joining jig is inserted are provided in the building members, respectively, the joining jig is inserted into the jig insertion holes and an adhesive that fixes the joining jig and the building members together is filled in the jig insertion holes, the joining jig to be inserted into the jig insertion holes is made of an elongated cylindrical material, has a pair of threaded end portions formed at both ends thereof, respectively, and has a non-threaded intermediate shaft portion formed between the pair of threaded end portions, the joining jig comprises a hollow portion on an inner circumference side of the joining jig to be filled with adhesive, an inside diameter of the intermediate shaft portion is equal to a diameter of the hollow portion, an inside diameter of the threaded end portions is equal to the diameter of the hollow portion, the threaded end portions are formed by rolling the both ends of the elongated cylindrical material, the non-threaded intermediate shaft portion is not subjected to rolling processing, such that the form of the elongated cylindrical material is retained, one of the pair of threaded end portions is placed in a jig insertion hole of one of the building members, the other one of the pair of threaded end portions is placed in a jig insertion hole of the other one of the building members, a slit portion is provided in the non-threaded intermediate shaft portion of the joining jig, an outside diameter of the slit portion is formed smaller than a root diameter of threads of the threaded end portions, and the slit portion is provided near one of the pair of threaded end portions and is placed in a jig insertion hole of one of the building members.

2. The joining structure according to claim 1, wherein an outside diameter of the non-threaded intermediate shaft portion is larger than a root diameter of the threaded end portions, and the outside diameter of the non-threaded intermediate shaft portion is smaller than an external diameter of the threaded end portions.

3. The joining structure according to claim 2, wherein the outside diameter of the non-threaded intermediate shaft portion is substantially equal to a pitch diameter of the threaded end portions.

4. The joining structure according to claim 1, wherein a size of the inside diameter of the joining jig is set such that a stiffness of the intermediate shaft portion of the joining jig is smaller than a stiffness at joint places between the threaded end portions and the adhesive, the stiffness at joint places between the adhesive and the jig insertion holes, and the stiffness of the building members when an external force is applied to the building members.

5. The joining structure according to claim 1, wherein a thickness of the joining jig is set to a thickness that causes yielding of a steel material at a joining strength or at lower than the joining strength between the threaded end portions and the adhesive.

6. A joining structure that joins at least two or more building members together, wherein a jig insertion hole into which a joining jig is inserted is provided in one of the at least two or more building members, the joining jig is inserted into the jig insertion hole and an adhesive that fixes the joining jig and one of the at least two or more building members together is filled in the jig insertion hole, the joining jig to be inserted into the jig insertion hole is made of an elongated cylindrical material, has a pair of threaded end portions formed at both ends thereof, respectively, and has a non-threaded intermediate shaft portion formed between the pair of threaded end portions, the joining jig comprises a hollow portion on an inner circumference side of the joining jig to be filled with adhesive, an inside diameter of the intermediate shaft portion of the joining jig is equal to a diameter of the hollow portion, an inside diameter of the threaded end portions of the joining jig is equal to the diameter of the hollow portion, the threaded end portions are formed by rolling the both ends of the elongated cylindrical material, the non-threaded intermediate shaft portion is not subjected to rolling processing, such that the form of the elongated cylindrical material is retained, one of the pair of threaded end portions is placed in the jig insertion hole of the one of the at least two or more building members, the other one of the pair of threaded end portions is inserted into an opening of a baseplate of the other of the at least two or more building members and is fixed to the baseplate with a nut, a slit portion is provided in the non-threaded intermediate shaft portion of the joining jig, an outside diameter of the slit portion is formed smaller than a root diameter of threads of the threaded end portions, and the slit portion is provided near one of the pair of threaded end portions and is placed in a jig insertion hole of the one of the at least two or more building members.

7. The joining structure according to claim 6, wherein an outside diameter of the non-threaded intermediate shaft portion is larger than a root diameter of the threaded end portions, and the outside diameter of the non-threaded intermediate shaft portion is smaller than an external diameter of the threaded end portions.

8. The joining structure according to claim 7, wherein the outside diameter of the non-threaded intermediate shaft portion is substantially equal to a pitch diameter of the threaded end portions.

9. The joining structure according to claim 6, wherein a size of the inside diameter of the joining jig is set such that a stiffness of the intermediate shaft portion of the joining jig is smaller than a stiffness at joint places between the threaded end portions and the adhesive, the stiffness at joint places between the adhesive and the jig insertion holes, and the stiffness of the building member when an external force is applied to the building member.

10. The joining structure according to claim 6, wherein a thickness of the joining jig is set to a thickness that causes yielding of a steel material at a joining strength or at lower than the joining strength between the threaded end portion and the adhesive.

11. A joining structure that joins at least two or more building members together, wherein jig insertion holes into which a joining jig is inserted are provided in the building members, respectively, the joining jig is inserted into the jig insertion holes and an adhesive that fixes the joining jig and the building members together is filled in the jig insertion holes, the joining jig to be inserted into the jig insertion holes is formed cylindrically, has a pair of threaded end portions formed at both ends thereof, respectively, and has a non-threaded intermediate shaft portion formed between the pair of threaded end portions, the threaded end portions are formed by rolling, one of the pair of threaded end portions is placed in a jig insertion hole of one of the building members, the other one of the pair of threaded end portions is placed in a jig insertion hole of the other one of the building members, a slit portion is provided in the non-threaded intermediate shaft portion of the joining jig, an outside diameter of the slit portion is formed smaller than a root diameter of threads of the threaded end portions, and the slit portion is provided near one of the pair of threaded end portions and is placed in a jig insertion hole of one of the building members.

* * * * *